US008771915B2

(12) United States Patent
Ueda et al.

(10) Patent No.: US 8,771,915 B2
(45) Date of Patent: Jul. 8, 2014

(54) IMAGE FORMING METHOD

(75) Inventors: Noboru Ueda, Tokyo (JP); Hiroshi Nagasawa, Tokyo (JP); Anju Hori, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 293 days.

(21) Appl. No.: 13/082,044

(22) Filed: Apr. 7, 2011

(65) Prior Publication Data

US 2011/0256479 A1 Oct. 20, 2011

(30) Foreign Application Priority Data

Apr. 16, 2010 (JP) ..... 2010-094725

(51) Int. Cl.
*G03G 13/20* (2006.01)

(52) U.S. Cl.
USPC ..... 430/124.3; 430/107.1; 430/108.6; 430/108.1

(58) Field of Classification Search
USPC ..... 430/107.1, 108.6, 108.1, 57.1, 124.3; 399/329, 341
See application file for complete search history.

(56) References Cited

U.S. PATENT DOCUMENTS

| | | | | |
|---|---|---|---|---|
| 6,983,119 | B2 * | 1/2006 | Nakayama | 399/341 |
| 2003/0180643 | A1 * | 9/2003 | Suzuki et al. | 430/108.6 |
| 2003/0186148 | A1 * | 10/2003 | Nakamura et al. | 430/107.1 |
| 2005/0158644 | A1 * | 7/2005 | Kondo et al. | 430/108.1 |
| 2007/0178399 | A1 * | 8/2007 | Kobayashi et al. | 430/124.3 |
| 2008/0090161 | A1 * | 4/2008 | Ishiduka | 430/57.1 |
| 2009/0068578 | A1 * | 3/2009 | Murakami et al. | 430/105 |
| 2009/0280428 | A1 * | 11/2009 | Matsuo | 430/124.3 |
| 2010/0080634 | A1 * | 4/2010 | Kimura | 399/329 |

FOREIGN PATENT DOCUMENTS

| | | |
|---|---|---|
| JP | 2002-148970 | 5/2002 |
| JP | 2004-109878 | 8/2004 |
| JP | 2008180938 A * | 8/2008 |

OTHER PUBLICATIONS

English translation of JP 2008180938 A, Aug. 2008, Japan, Matsushima et al.*
English translation of claims of JP 2008180938 A, Aug. 2008, Japan, Matsushima et al.*

* cited by examiner

*Primary Examiner* — Mark F Huff
*Assistant Examiner* — Rashid Alam
(74) *Attorney, Agent, or Firm* — Lucas & Mercanti, LLP

(57) ABSTRACT

An image forming method is disclosed, comprising transferring and fixing steps, wherein fixing is performed by a fixing device in which at least one of a heating member and a pressing member comprises an endless belt entrained about plural rollers, and the heating member and the pressing member are pressed against each other to form a fixing nip, and wherein toner particles contains a binder resin which has a domain/matrix structure constituted of a high-elastic resin forming a domain and a low-elastic resin forming a matrix in an elastic image obtained when observing the toner particles by an atomic force microscope with respect to a section of the individual toner particles, in which an arithmetic average value of a ratio (L/W) of a major axis (L) to a minor axis (W) of individual domains is 1.5 to 5.0, and domains having the major axis (L) of 60 to 500 nm account for not less than 80% by number of total domains and domains having the minor axis (W) of 45 to 100 nm account for not less than 80% by number of total domains.

8 Claims, 4 Drawing Sheets

IMAGE FORMING METHOD

This application claims priority from Japanese Patent Application No. 2010-094725, filed on Apr. 16, 2010, which is incorporated hereinto by reference.

FIELD OF THE INVENTION

The present invention relates to an image forming method by use of an electrophotographic toner.

BACKGROUND OF THE INVENTION

There have been proposed fixing devices of various systems to heat-fixing unfixed toner images in an image forming apparatus such as an electrophotographic copying machine, printer, or facsimile. Such fixing devices include, for example, a fixing device of a belt-nip system in which a fixing belt is pressed against a heating member or a pressing member.

There is cited, for example, a fixing device of a belt-nip system, as disclosed in JP 2004-109878A, which is constituted of a rotatably supported heating member, an endless belt with its outer circumference pressed against the heating member, the inner circumference of the endless belt and a pressure-applying member, pressed against the inner circumference of the endless belt and pressing the heating member through the endless belt along the outer circumference of the heating member. Such a fixing device of a belt-nip system can maintain a sufficient nip-transit time, that is, a sufficient contact time of an unfixed toner image with a heating member, so that an image of high gloss can be obtained.

However, such a fixing device of a belt-nip system, in which a pressure-applying member with an upper surface formed of an elastic layer such as rubber is disposed with being brought into contact with the inner circumference of an endless belt, results in increased slide resistance, leading to unstable rotary movement and producing problems such as occurrence of slippage of images. Specifically in cases when forming a solid image with an increased toner adhesion amount, occurrence of slippage of images results in microscopic wrinkles, which are visibly observed as uneven gloss.

Accordingly, to solve such problems is disclosed a technique of covering the upper surface of a pressure-applying member (hereinafter, also denoted as a slide-sheet) with a sheet member of a glass fiber sheet coated with a fluororesin (PFA) to inhibit abrasion of the inner circumference surface of a endless belt and a technique of covering the surface of a pressure-applying member with a slide sheet of a concave-convex surface to lessen contact areas to reduce friction, as described in JP 2002-148970A. However, such techniques complicate the constitution of a fixing device, producing problems such that an exchange cycle is shortened along with deterioration of the belts or slide sheets.

SUMMARY OF THE INVENTION

The present invention has come into being taking into account the foregoing circumstances. It is an object of the present invention to provide a method for forming images with enhanced gloss with inhibiting occurrence of slippage of images.

One aspect of the present invention is directed to an image forming method comprising the steps of:

(a) transferring a toner image formed on an image support onto a transfer material, and (b) fixing the toner image transferred onto the transfer material, wherein in step (b), fixing is conducted by using a fixing device in which at least one of a heating member and a pressing member comprises an endless belt entrained about plural rollers, and the heating member and the pressing member are pressed against each other to form a fixing nip, and a toner forming the toner image comprises toner particles containing a binder resin;

in an elastic image (which are hereinafter also denoted as AFM elastic images) obtained when observing the toner particles by an atomic force microscope (AFM) with respect to the section of the individual toner particles, the binder resin has a domain/matrix structure constituted of a high-elastic resin forming a domain and a low-elastic resin forming a matrix, an arithmetic average value of a ratio (L/W) of a major axis (L) to a minor axis (W) of the individual domains is in the range of from 1.5 to 5.0, and domains having the major axis (L) falling within a range of from 60 to 500 nm account for not less than 80% by number of total domains and domains having the minor axis (W) falling within a range of from 45 to 100 nm account for not less than 80% by number of total domains.

To make it feasible to achieve enhanced glossiness and inhibit slippage of images, there was studied functional separation of the respective effects, and a toner was prepared which was composed of a resin of low softening point and low elasticity in terms of high glossiness and a resin of high elasticity in terms of prevention of slippage of images. However, it was proved that sufficient effects were not achieved by control of the structure of toner particles employing the conventional technology. So, a toner was prepared through an orientation manner of a resin having a domain matrix structure and enhanced glossiness was achieved by reducing the size of the spherical domain to a level of less than the visible light wavelength but prevention of slippage of images was still not satisfactory.

Accordingly, the problems of the present invention were overcome by use of a toner comprised of a binder resin having introduced a domain of being sort of the rod shape, that is, the shape as defined in the present invention (hereinafter, also denoted as "specific shape"). According to the image forming method of the present invention, when using a fixing device of a belt-nip system, the use of a specific toner inhibited occurrence of slippage of images, while achieving glossiness of the formed image.

The reason that occurrence of slippage of images is inhibited with achieving glossiness of the formed image when using a fixing device of a belt-nip system can be presumed to be as follows. Generally, in a system of plural resins differing in thermal property being present as a mixture, the whole of the system exhibits an averaged thermal property. However, it is presumed that, in binder resins related to the present invention, a high-elastic resin constituting a domain (which is hereinafter also denoted as a domain resin) and a low-elastic resin forming a matrix (which is hereinafter also denoted as a matrix resin) are greatly different in thermal property, so that the matrix resin and the domain resin exhibit no interaction with each other at a lower end of the fixing temperature, and only the matrix resin exhibiting a low softening point melts and the domain resin is not involved in melting, so that the domain resin does not disturb melting deformation of a toner.

One of causes for occurrence of slippage of images is presumed to be that, in the stage of fixing, the elasticity of a melted toner within a fixing nip section is lowered and slide slippage is caused between the fixing member and the transfer member, and thereby, microscopic rupture is generated on the image surface, leaving wrinkles. It is also presumed that, in the image forming method of the present invention, the use of a toner in which the domain is a binder resin having a specific form enhances the grip power of a toner forming a toner image onto a transfer material, inhibiting occurrence of slippage of images.

Further, the reason that enhanced glossiness is achieved in the formed image is presumed to be that the domain is a magnitude less than a visible light wavelength and falling within a specific range, whereby the surface of the formed image is controlled to a roughness not causing diffused reflection.

DETAILED DESCRIPTION OF THE INVENTION

Figure 1A:
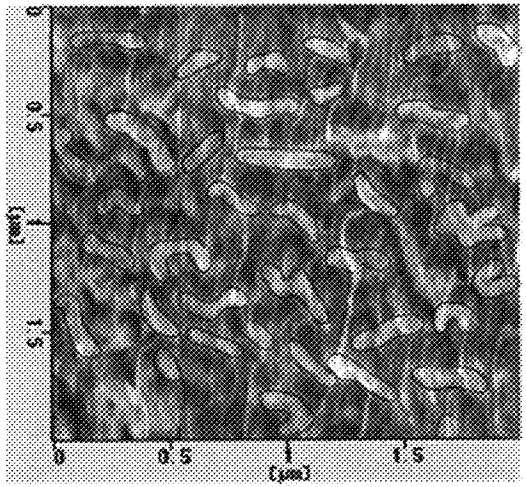
FIGS. 1*a*, 1*b* and 1*c* are an AMF elastic image observed by an AMF, showing an example of the section of a toner particle related to the present invention.

Hereinafter, there will be described the present invention in detail.

Image Forming Method:

The image forming method of the present invention comprises at least a transfer step for transferring a toner image formed on an image support onto a transfer material and a fixing step for fixing the toner image transferred onto the transfer material, and specifically comprises the following steps (1) to (5):

(1) a charging step of electrostatically charging the surface of an image support,
(2) an exposure step of exposing the electrostatically charged surface to light to form an electrostatic latent image on the image support,
(3) a development step of developing the electrostatic latent image formed on the image support with a developer containing a toner to form a toner image,
(4) a transfer step of transferring the toner image formed on the image support onto a transfer material, and
(5) a fixation step of fixing the toner image transferred onto the transfer material.

In the fixing step (5), fixing is conducted by using a fixing device in which at least one of a heating member and a pressing member comprises an endless belt entrained about plural rollers and the heating member and the pressing member are pressed against each other to form a nip (which is also denoted as a fixing nip). Further, a toner which forms the toner image comprises toner particles containing a binder resin and in an elastic image (AFM elastic image) obtained when observing the section of a toner particle in atomic force microscopy (AFM), the binder resin has a domain/matrix structure comprised of a high-elastic resin constituting a domain and a low-elastic resin constituting a matrix, an arithmetic average value of a ratio (L/W) of a major axis (L) to a minor axis (W) of the individual domains is in the range of from 1.5 to 5.0, and domains having a major axis (L) falling within a range of from 60 to 500 nm account for not less than 80% by number of total domain and domains having a minor axis (W) falling within a range of from 45 to 100 nm account for not less than 80% by number of total domains.

Toner:

The toner used in the image fanning method of the present invention comprises toner particles containing a binder resin of a domain/matrix structure. The toner particles related to the present invention may optionally contain internal additives such as a colorant, a releasing agent or a charge controlling agent.

The toner related to the invention preferably exhibits a glass transition point of 25 to 55° C. and more preferably 30 to 45° C.

The glass transition point of a toner can be determined by using a differential scanning calorimeter, Diamond DSC (produced by Perkin Elmer Inc.). The measurement is conducted as follows. A toner of 4.5-5.0 mg is precisely weighed to two places of decimals, sealed into an aluminum pan (Kit No. 0219-0041) and set into a DSC-7 sample holder. An empty aluminum pan is used as a reference. The temperature is controlled through heating-cooling-heating at a temperature-rising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point.

The toner related to the present invention preferably exhibits a softening point of 90 to 110° C. and more preferably 95 to 105° C. In cases when the softening point of a toner is excessively low, it is a concern that inhibition of occurrence of slippage of images becomes insufficient and in cases when the softening point of a toner is excessively high, it is a concern that formed images do not exhibit sufficiently high glossiness.

The softening point of a toner can be determined, for example, in the manner described below.

Under an environment of 20±1° C. and 50±5% RH, 1.10 g of a toner is placed into a petri dish, flattened, allowed to stand for 12 hrs and compressed under a pressure of 3820 kg/cm$^2$ for 30 sec. by using a molding machine (SSP-10A, produced by Shimazu Seisakusho Co., Ltd.) to form a disc-molded sample with 1 cm diameter.

Using a flow tester (CFT-500D, produced by Shimazu Seisakusho Co., Ltd.) and under an environment of 24±5° C. and 50+20% RH, the thus formed sample is extruded through a hole of a cylinder type die [1 mm (diameter)×1 mm] by using a piston of 1 cm diameter after completion of pre-heating under conditions of a load of 180N, a start temperature of 40° C., pre-heating time of 300 sec. and a temperature increasing rate of 6° C./min. An off-set method temperature ($T_{offset}$) which is measured at an offset value of 5 mm in a melting temperature measurement by a temperature increasing method, is defined as the softening point of the toner.

Toner particles constituting the toner related to the present invention preferably exhibit a volume-based median diameter of 3 to 12 μm, and more preferably 4 to 9 μm. Toner particles of a volume-based median diameter falling with the foregoing range are capable of forming an image of enhanced image quality.

The volume-based median diameter of toner particles can be determined by using a measurement apparatus in which a Coulter Multisizer 3 (produced by Beckmann Coulter Co.) is connected to a computer system installed with software for data processing (Software V3.51).

Toner particles constituting the toner related to the present invention preferably exhibit an average circularity of 0.930 to 1.000, and more preferably 0.950 to 0.995.

In the present invention, the average circularity degree can be determined by using FPIA-2100 (produced by Sysmex Co., Ltd.). Specifically, toner particles are blended in an aqueous surfactant solution and dispersed using an ultrasonic homogenizer for 1 min. The measurement condition is set to HPF (high power focusing) mode and the measurement is carried out at an optimum concentration of the HPF detection number of 3000-10000. Reproducible data are obtained in such a range. The circularity degree is defined as below:

Circularity degree=(circumference length of a circle having an area equivalent to a projection of a particle)/(circumference length of a projection of a particle).

The average circularity degree is the sum of circularity degree values of total particles divided by the number of particles.

Binder Resin:

A binder resin contained in toner particles constituting the toner related to the present invention has a domain/matrix structure formed of a high-elastic resin constituting a domain and a low-elastic resin constituting a matrix in an AFM elastic image observed by atomic force microscopy, that is, an elastic image obtained when observing the toner particles by an atomic force microscope (AFM) with respect to the section of the individual toner particles.

In the present invention, the domain structure refers to a structure in which an area composed of a high-elastic resin exhibiting a higher elasticity than the resin constituting the matrix, that is, a domain is formed in a continuous matrix phase composed of a low-elastic resin.

As is specifically shown in FIG. 1, a binder resin of the domain/matrix structure related to the present invention is to be in a state in which domains (denoted as light portions) composed of a domain resin and exhibiting a specific form are dispersed in a matrix (denoted as a dark portion) composed of a matrix resin. The domain/matrix structure of a binder resin can be confirmed by observing the section of a toner particle by using an atomic force microscope, SPM (SPI 3800N, produced by Seiko Instrument Co.).

Specifically, toner particles which were subjected to humidity conditioning under an environment of a temperature of 20° C. and a humidity of 50% RH and hardening them, are embedded in a UV curing resin and cured, and then sliced to clip the observation surface to prepare a sample. Using an atomic force microscope SPM (SPI 3800N) and a cantilever SN-AF 01 (each, made by Seiko Instrument Co.), an area of 2 μm square was observed at room temperature, while being scanned in a micro-viscoelastic mode. After forming pellets, they were aged with heating to fill voids between particles, whereby measurement errors due to surface irregularity can be prevented.

In the AFM elastic image shown in FIG. 1, there were used toner particles containing no internal additive such as a colorant or a releasing agent to confirm the dispersion state of a binder resin of the domain/matrix structure. In toner particles related to the present invention, an AFM elastic image similar to the AFM elastic image shown in FIG. 1 is observable in an area which is not affected by an internal additive such as a colorant or a releasing agent.

Domain:

A domain resin constituting a binder resin of a domain structure is not specifically limited and examples thereof include a styrene-acryl resin and a (meth)acrylic ester copolymer. A (meth)acrylic ester copolymer is preferred in terms of its domain shape being easily controllable, and a copolymer of methyl methacrylate, butyl acrylate and itaconic acid is specifically preferred.

The storage modulus (that is, storage modulus of elasticity) of a domain resin is preferably from $4.0\times10^5$ to $1.0\times10^8$ dyn/cm$^2$ at 100° C. in terms of attainment of enhanced glossiness a prevention of image slippage.

The storage modulus of a domain resin at 100° C. can be determined according to a measurement instrument, conditions and the procedure, as described below:

Measurement instrument: MR-500 Soliquid Meter (produced by Rheology Co., Ltd.

Measurement condition:

frequency; 1 Hz measurement mode; parallel plate of 0.997 cm of diameter

Measurement Procedure:

(1) Under an environment of 20±1° C. and 50±5% RH, 0.6 g of a domain resin is placed into a petri dish, flattened, allowed to stand for at least 12 hrs and compressed under a pressure of 3820 kg/cm$^2$ for 30 sec. by using a molding machine (SSP-10A, produced by Shimazu Seisakusho Co., Ltd.) to form a disc-molded toner pellet with 1 cm diameter;

(2) The toner pellet is placed on a parallel plate installed in a measurement instrument;

(3) After adjusting the measurement section temperature to the softening point of the domain resin minus 50° C., a parallel plate gap is adjusted to 3 mm;

(4) After cooling the measurement section temperature to 35° C., the temperature of the measurement section is raised to 200° C. at a rate of 2° C./min, while applying a sine wave oscillation at a frequency of 1 Hz, and a storage modulus is measured at the prescribed temperature (100° C.). The strain angle is varied within a range of 0.02 to 5 deg. so that a torque value (R. Tolq) does not become not more than 1%.

The storage modulus of a domain resin can be controlled by adjusting the resin composition or molecular weight of the domain resin. The molecular weight of a domain resin can be controlled by adjusting the quantity of a chain-transfer agent used in the step of preparing a dispersion of resin particles B composed of the domain resin [step (b)] in the process of producing a toner, as described later.

In the AFM elastic image of a 2 μm square and obtained in the manner described above, the arithmetic average value of a ratio (L/W) of major axis (L) to minor axis (W) is preferably from 1.5 to 5.0, and more preferably from 1.7 to 4.2.

Figure 1B:
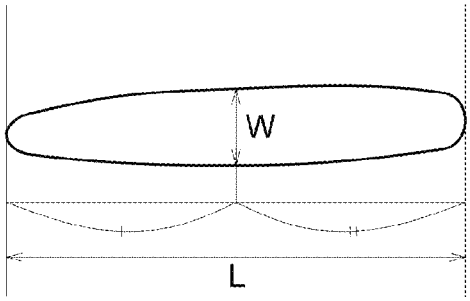
Figure 1C:
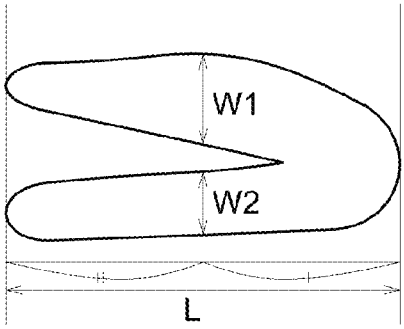

In the AFM elastic images within the 2 μm square, obtained in the manner described above, outlines are drawn for the individual domains, as shown in FIG. 1*a*, and when sandwiching each of the outlines between two parallel lines, the major axis (L) of the domain refers to the maximum value of distances between the two parallel lines and the minor axis (D) of the domain refers to the distance between two points at which a perpendicular bisector of the major axis (L) intersects an outline, as shown in FIG. 1*b*, provided that, in cases when plural segments corresponding to W are included, the shortest distance between the parallel two lines is defined as W. Specifically, as shown in FIG. 1*c*, a perpendicular bisector of the major axis (L) and the outline of the domain intersect at four points and $W_1$ and $W_2$ are present, a smaller value of $W_1$ and $W_2$ is defined as W.

The AFM elastic image shown in FIG. 1 indicates one in a state at which noises arising from height signals are removed with reference to height image falling within the same range.

In the AFM elastic image of the 2 μm square and obtained by the method described above, domains of the major axis (L) falling within a range of 60 to 500 nm exist in an amount of not less than 80% by number and domains of the minor axis (W) falling within a range of 45 to 100 nm exist in an amount of not less than 80% by number. Thus, when domains of which the major axis (L) and the minor axis (W) satisfy the foregoing ranges account for not less than 80% by number of total domains, the thus formed image achieves enhanced glossiness. When domains of which the major axis (L) and the minor axis (W) satisfy the foregoing ranges account for less than 80% by number of total domains, the formed image does not attain sufficiently high glossiness and does not attain sufficient resistance to image slippage. Specifically, in cases when the major axes (L) of the domains exceed 500 nm or the minor axes (W) exceed 100 nm, the thus formed image does not achieve sufficiently high glossiness and does not attain sufficient resistance to image slippage. On the other hand, in cases when the major axes (L) of the domains is less than 100 nm or the minor axes (W) is less than 45 nm, sufficient resistance to image slippage cannot be attained.

The minor axis (W) of a domain can be controlled by adjusting the particle size of resin B particles composed of a domain resin in the method of producing a toner [specifically, at step (b)], as described later. The particle size of the resin B particles can be controlled in the process of producing the resin B particles, preferably by adjusting the amount of a surfactant added in the process of emulsion polymerization. The major axis (L) of a domain can be controlled by adjusting the ratio (MID) of addition mass (M) of resin A particles composed of a matrix resin to addition mass (D) of resin B particles composed of a domain resin in the method of producing a toner [specifically, at step (d)], as described later. Specifically, it is preferred to control the ratio (MID) so as to fall within the range, as defined in the following formula (1):

$$70/30 \leq M/D \leq 95/5 \qquad \text{Formula (1)}$$

In the AFM elastic image of a 2 μm square, obtained by the method described above, the arithmetic average value of areas of the individual domains is preferably in the range of from 0.005 to 0.05 $\mu m^2$, and more preferably from 0.01 to 0.05 $\mu m^2$. When the arithmetic average value of areas of the individual domains falls within the foregoing range, domains of moderate size are dispersed in the matrix, whereby image slippage is inhibited, while achieving enhanced glossiness of the formed image. When the arithmetic average value of areas of the individual domains is less than 0.005 $\mu m^2$, it is a concern that sufficient resistance to image slippage is not attained. On the other hand, when the arithmetic average value of areas of the individual domains exceeds 0.05 $\mu m^2$, it is a concern that an image of enhanced glossiness is not formed with enhanced reproducibility.

The area (S) of a domain is calculated by the following equation (1):

$$S(\mu m^2)=(L\times W)-\{W^2-\pi(\tfrac{1}{2}W)^2\} \qquad \text{Equation (1)}$$

The glass transition point of a domain resin is preferably from 60 to 80° C., and more preferably from 63 to 68° C. in terms of controlling the major axis (L) and minor axis (W) of a domain.

The glass transition point of a domain resin can be determined by using a differential scanning calorimeter, Diamond DSC (produced by Perkin Elmer Inc.). The measurement is conducted as follows. A domain resin (domain resin particles) of 4.5-5.0 mg is precisely weighed to two places of decimals, sealed into an aluminum pan (Kit No. 0219-0041) and set into a DSC-7 sample holder. An empty aluminum pan is used as a reference. The temperature is controlled through heating-cooling-heating at a temperature-rising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point.

The softening point of a domain resin is preferably from 150 to 200° C., and more preferably from 170 to 190° C. When the softening point of a domain resin falls within the foregoing range, sufficient resistance to hot offset can be achieved.

The softening point of a domain resin can be determined, for example, in the manner described below.

Under an environment of 20±1° C. and 50±5% RH, 1.10 g of a domain resin is placed into a petri dish, flattened, allowed to stand for 12 hrs and compressed under a pressure of 3820 $kg/cm^2$ for 30 sec. by using a molding machine (SSP-10A, produced by Shimazu Seisakusho Co., Ltd.) to form a disc-molded sample with 1 cm diameter.

Using a flow tester (CFT-500D, produced by Shimazu Seisakusho Co., Ltd.) and under an environment of 24±5° C. and 50±20% RH, the thus formed sample is extruded through a hole of a cylinder type die (1 mm×1 mm) by using a piston of 1 cm diameter after completion of pre-heating under conditions of a load of 196 N (20 kgf), a start temperature of 60° C., pre-heating time of 300 sec. and a temperature increasing rate of 6° C./min. The off-set method temperature ($T_{offset}$) which is measured at an offset value of 5 mm in a melting temperature measurement by a temperature increasing method, is defined as the softening point of the domain resin.

The mass average molecular weight (Mw) of a domain resin, which is represented by equivalent converted to standard polystyrene, is preferably from 10,000 to 350,000, and more preferably from 250,000 to 300,000.

The mass average molecular weight (Mw) can be determined by gel permeation chromatography (GPC) and is performed in the following manner. Using an apparatus, HLC-8220 (produced by TOSO Co., Ltd.) and a column, TSK guard column+TSK gel Super HZM-M3 3 Series (produced by TOSO Co., Ltd.), tetrahydrofiran (THF) as a carrier solvent is allowed to flow at a flow rate of 0.2 ml/min, while maintaining a column temperature at 40° C. The domain resin is dissolved in tetrahydrofuran (THF) at room temperature, while being stirred over 5 min. by an ultrasonic homogenizer to obtain a solution at a concentration of 1 mg/ml. Subsequently, the solution is filtered with a membrane filter having a pore size of 0.2 μm to obtain a sample solution. Into an apparatus was injected 10 μl of the obtained sample solution together with the foregoing carrier solvent and detected by using a refractive index detector (RI detector). The molecular weight distribution of a sample is determined by use of a calibration curve which was prepared by using monodisperse polystyrene standard particles to determine the molecular weight. There were used 10 points of standard polystyrene samples used for preparation of a calibration curve.

The content of a domain resin is preferably from 2.5 to 30% by mass of the whole of a binder resin, and more preferably from 2.5 to 15% by mass. When the content of the domain resin falls within the foregoing range, image slippage is inhibited, while achieving enhanced glossiness of the formed image.

Matrix:

A matrix resin constituting a binder resin of the domain/matrix structure is not specifically limited but is appropriately chosen according to the main performance required as a toner (for example, glossiness, fixability, etc.), and examples thereof include a polyester resin and a styrene-acryl resin.

The storage modulus of elasticity of a matrix resin at 100° C. is preferably from $1.0\times10^2$ to $1.0\times10^4$ dyn/cm$^2$. When the storage modulus of a matrix resin at 100° C. is less than $1.0\times10^2$ dyn/cm$^2$, it is a concern that sufficient resistance to image slippage is not achieved. On the other hand, when the storage modulus of a matrix resin at 100° C. exceeds $1.0\times10^4$ dyn/cm$^2$, it is a concern that an image of high glossiness can not be formed with enhanced reproducibility.

The glass transition point of a matrix resin is preferably from 25 to 50° C. in terms of achieving low temperature fixability, and more preferably from 30 to 40° C.

The softening point of a matrix resin is preferably from 80 to 120° C. in terms of achieving enhanced glossiness, and more preferably from 90 to 100° C.

The mass average molecular weight of a matrix resin is preferably from 10,000 to 30,000, and more preferably from 15,000 to 25,000.

Measurement methods for storage modulus, glass transition point, softening point and mass average molecular weight (Mw) of a matrix resin are respectively the same as for the above-described methods for storage modulus, glass transition point, softening point and mass average molecular weight (Mw) of a matrix resin, except that the domain resin is replaced by a matrix resin (or resin particles composed of a matrix resin).

In the toner related to the present invention, a binder resin is comprised of a high-elastic resin constituting a domain and a low-elastic resin constituting a matrix, and there may be contained at least a commonly known resin other than the high-elastic resin and the low-elastic resin.

Colorant:

Colorants used for toner particles constituting the toner related to the present invention can employ commonly known dyes and pigments. Colorants to obtain a black toner can employ those known to one skilled in the art, such as carbon black, a magnetic material, a dye, and an inorganic pigment containing a non-magnetic iron. Colorants to obtain a color toner can employ commonly known dyes and organic pigment. Colorants to obtain the individual color may employ one or more of them.

The content of a colorant is preferably from 1 to 10% by mass, and more preferably from 2 to 8% by mass. When the colorant content is less than 1% by mass, it is a concern that a toner is insufficient in coloring power; and when a colorant content exceeds 10% by mass, it is a concern that colorant release or its adhesion to a carrier or the like occurs, adversely affecting electrostatic-charging property.

Releasing Agent:

Releasing agents used for the toner related to the present invention are not specifically restricted and examples thereof include polyethylene wax, oxidized polyethylene wax, polypropylene was, oxidized polypropylene wax, carnauba wax, sasol wax, rice wax, and candelilla wax. The amount of wax contained in toner particles is preferably from 0.5 to 25 parts by mass of 100 parts by mass of a binder resin, and more preferably from 3 to 15 parts by mass.

Charge Control Agent:

A charge control agent used for toner particles constituting the toner related to the present invention can employ commonly known compounds such as a metal complex, an ammonium salt, and calixarene. The amount of a charge control agent contained in toner particles is preferably from 0.1 to 10 parts by mass of 100 parts by mass of a binder resin, and more preferably from 0.5 to 5 parts by mass.

External Additive:

Toner particles constituting the toner related to the present invention may be used as a toner without any change, but so-called external additives such as a fluidizing agent or a cleaning aid to improve fluidity, electrostatic-charging property or cleaning capability. Examples of such a fluidizing agent include inorganic particles composed of silica, alumina, titanium oxide, zinc oxide, iron oxide, copper oxide, lead oxide, antimony oxide, yttrium oxide, magnesium oxide, barium titanate, ferrite, colcothar, magnesium fluoride, silicon carbide, boron carbide, silicon nitride, zirconium nitride, magnetite or magnesium stearate. It is preferred that these inorganic particles are subjected to a surface treatment by use of a silane coupling agent, a titanium coupling agent, a higher fatty acid or silicone oil to achieve enhanced dispersibility or environmental stability.

Examples of a cleaning aid include polystyrene particles and poly(methyl methacrylate) particles.

External additives may be used singly or in combination of them. A total addition amount of external additives is preferably from 0.1 to 20% by mass of a toner.

Developer:

The toner related to the present invention may be used as a magnetic or non-magnetic single-component developer or mixed with a carrier to be used as a two-component developer. In cases when using the toner of the present invention as a two-component developer, there are usable magnetic particles composed of commonly known materials, for example, a metal such as iron, ferrite or magnetite, or an alloy of such a metal and a metal such as aluminum or lead. Of these materials are preferred ferrite particles. A carrier may employ a coated carrier in which the surface of a magnetic particle is coated with a covering agent such as a resin or a dispersion type carrier formed of a powdery magnetic material dispersed in a binder resin.

The volume-based median diameter of a carrier is preferably from 15 to 100 μm, and more preferably from 20 to 80 nm. The volume-based median diameter of a carrier can be measured by laser diffraction sensor HELOS (produced by SYMPATECS Co., Ltd.) which is installed with a wet disperser.

Examples of a preferred carrier include a resin coverage carrier in which the surfaces of magnetic particles are covered with a resin and a resin dispersion type carrier in which magnetic particles are dispersed in a resin. Resins constituting such a resin coverage carrier are not specifically limited and examples thereof include an olefinic resin, a styrene resin, a styrene-acryl resin, a silicone resin, an ester resin and a fluorine-containing polymer resin. A resin constituting a resin dispersion type carrier is not specifically limited but can employ resins commonly known in the art, and examples thereof include a styrene-acryl resin, a polyester resin, a fluorinated resin and a phenol resin.

Production Method of Toner:

A method for producing a toner related to the present invention is not specifically limited so long as it is a method capable of obtaining toner particles containing a binder resin in which domains formed of a domain resin and having a specific form are dispersed in a matrix formed of a matrix resin, of which an emulsion polymerization aggregation method or a mini-emulsion polymerization aggregation method is preferred, in which a domain resin can be easily introduced into a matrix resin.

As a method for producing a toner related to the present invention is shown below specific steps (a)-(h) of an emulsion polymerization aggregation method. The method comprises the steps of:

(a) the step of preparing a dispersion (A) of resin A particles comprised of a low-elastic resin constituting a matrix, (b) the step of preparing a dispersion (B) of resin B particles comprised of a high-elastic resin constituting a domain and exhibiting a glass transition temperature of 60 to 80° C. and a softening point of 150 to 200° C.;

(c) the step of preparing a dispersion (X) of fine particles of a colorant (hereinafter, also denoted as colorant particles);

(d) the step of mixing a dispersion (A), a dispersion (B) and a dispersion (X) and allowing the resin A particles, the resin B particles and the colorant particles to coagulate and fuse to form aggregated particles;

(e) the step of adding particles used for shelling to form a shell layer;

(f) the step of ripening the particles to control a domain-matrix structure, while stirring under the temperature condition near the softening point of the resin A particles and less than the softening point of the resin B particles;

(g) the step of filtering off the aggregated particles from a coagulated particle dispersion (with an aqueous medium) to remove a surfactant and the like from the aggregated particles; and (h) the step of drying the thus washed particles to obtain toner particles; and the shelling step (e) may optionally be conducted.

In the present invention the aqueous medium refers to a medium composed of 50 to 100% by mass of water and 0 to 50% by mass of an aqueous soluble organic solvent. Examples of such a aqueous-soluble organic solvent include methanol, ethanol, isopropanol, butanol, acetone, methyl ethyl ketone, and tetrahydrofuran. Of these is preferred an alcoholic organic solvent which does not dissolve the obtained resin.

Step (a):

The resin A particles can be prepared through an emulsion polymerization method, a seed polymerization method or a mini-emulsion polymerization method by using a radical-polymerizable monomer as a raw material. They can also be prepared through a phase inversion method in which a resin solution of an organic solvent is subjected to phase inversion in an aqueous medium.

The resin A particles may be constituted of at least two layers formed of resins differing in composition, which can be prepared in such a manner that, to a dispersion of resin particles prepared according to the conventional emulsion polymerization process (1st polymerization), a polymerization initiator and a polymerizable monomer are added and subjected to a polymerization treatment (2nd polymerization).

The resin A particles preferably exhibit a volume-based median diameter falling within a range of from 45 to 350 nm, and more preferably, from 45 to 210 nm. The volume-based median diameter of the resin A particles can be determined in the manner in which a few drops of a sample are added into a measuring cylinder, pure water is added thereto and a mixture is dispersed in an ultrasonic washing machine (US-1, produced by AS ONE Corp.) to prepare a measuring sample, and the thus prepared sample is measured by using Micro Track UPA-150 (produced by Nikkiso Co., Ltd.).

The resin A particles preferably exhibit a glass transition point of from 25 to 50° C., and more preferably, from 90 to 100° C.

A polymerization initiator used in the step (a) can employ any water-soluble polymerization initiator. Examples of such a polymerization initiator include a persulfate (e.g., potassium persulfate, ammonium sulfate), an azo compound [e.g., 4,4'-azobis-4-cyanovalerianic acid and its salt, 2,2'-azobis(2-amidinopropane) salt] and a peroxy-compound.

Chain Transfer Agent:

In the step (a) are usable conventionally used chain transfer agents to control the molecular weight of the resin A particles. A chain transfer agent is not specifically limited and examples thereof include 2-chloroethanol, mercaptans such as octylmercaptan, dedecylmercaptan, t-decymercaptan, and styrene dimmer.

Surfactant:

In the step (a), there may be added a surfactant to allow the resin particles to be stably dispersed. Such a surfactant is not specifically restricted and various surfactants are usable, but preferred examples of an ionic surfactant include a sulfonate such as sodium dodecybenzenesulfonate or sodium arylalkylpolyether-sulfonate; a sulfuric acid ester salt such as sodium dodecysulfate, sodium tetradecylsulfate, sodium pentadecylsulfate, or sodium octylsulfate; and a carboxylic acid salt such as sodium oleate, sodium laurate, sodium caprate, sodium caprylate, sodium caproate, potassium stearate, and calcium oleate. There are also usable nonionic surfactants such as polyethylene oxide, polypropylene oxide, a combination of polyethylene oxide and polypropylene oxide, an ester of polyethylene glycol and a higher fatty acid, alkylphenol polyethyleneoxide, an ester of a higher fatty acid and polyethylene glycol, an ester of a fatty acid and polypropylene oxide, and sorbitan ester. Such surfactants may be used singly or in combination of them.

Step (b):

The resin B particles can be prepared by the process of emulsion polymerization, seed polymerization or mini-emulsion polymerization, with using a radical-polymerizable monomer. It can also prepared by a process of phase inversion emulsification, in which a resin solution using an organic solvent is subjected to phase inversion in an aqueous medium.

With respect to the particle size of the resin B particles, the volume-based median diameter thereof falls preferably within the range of from 30 to 140 nm, and more preferably from 45 to 100 nm.

The volume-based median diameter of the resin B particles can be determined in the same manner as in the resin A particles described above, except that a measurement sample is replaced by the resin B particles.

The glass transition point of the resin B particles is preferably from 60 to 80° C., and more preferably from 63 to 68° C.; the softening point of the resin B particles is preferably from 150 to 200° C., and more preferably from 170 to 190° C.

In the step (b) are usable a polymerization initiator, a chain transfer agent and a surfactant which are similar to those used in the step (a).

Step (c):

The particle size of colorant particles falls preferably within the range of 10 to 300 nm in terms of volume-based median diameter.

The volume-based median diameter of the colorant particles can be determined in the same manner as in the resin A particles described above, except that the measurement sample is replaced by the colorant particles.

Step (d):

In the step (d), the coagulation temperature preferably is higher than the glass transition point of the resin A particles, whereby the resin A particles are fused, while being coagulated, and are fused with the resin B particles and the colorant particles to obtain aggregated (or coalesced) particles.

In the step (d), the major axis of a domain can be controlled by adjusting an addition ratio of resin A particles to resin B particles. Specifically, it is preferred to control the ratio (M/D) of addition mass (M) of the resin A particles to mass (D) of the resin B particles so as to fall within the range defined in the following relational expression (1):

$$70/30 \leq M/D \leq 95/5 \quad \text{Expression (1):}$$

In the step (d), the temperature is raised, while adding a coagulant, whereby coagulation is initiated.

Coagulant:

Coagulants usable in the step (d) include, for example, an alkali metal salt and an alkaline earth metal salt. Alkali metals capable of forming a coagulant include lithium, potassium and sodium; alkaline earth metals capable of forming a coagulant include magnesium, calcium, strontium and barium. Of these are preferred potassium, sodium, magnesium, calcium and barium. Counter ions of the foregoing alkali metal or alkaline earth metal (that is, anions constituting a salt) include a chloride ion, a bromide ion, an iodide ion, a carbonate ion and a sulfate ion.

Step (e):

In the method of preparing the toner related to the present invention, the resin A particles and the resin B particles are subjected to coagulation and fusion to form a binder resin of a domain/matrix structure. It is preferred to form a core portion with the resin of a domain/matrix structure and to form a shell with a resin (hereinafter, also denoted as a shelling resin) differing in composition from the domain resin and the matrix resin.

Step (f):

In the step (f), aggregated particles are ripened under the temperature condition near the softening point of the resin A particles but less than the softening point of the resin B particles. Under such temperature conditions, the step of ripening aggregated particles, whereby the major axis of the domain is controlled. The temperature near the softening point of the resin A particles is preferably within the range of (softening point of the resin A)±10° C.

It is presumed that, in the step (f), after the resin A particles and the resin B particles are coagulated and fused, orientation of the resin B which has not completely been melted, proceeds slowly in a matrix resin derived from the resin A particles of relatively lowered viscosity. Further, it is presumed that the domain forms a specific form specifically in the ripening step of ripening coagulated particles under the temperature condition of being higher than the glass transition point and lower than the softening point of the resin B. It is presumed that, in the step (f), single or plural resin B particles (specifically, 2-4 particles) are coagulated on a single axis to form a domain of a specific form.

The ripening step is conducted, while stirring at a temperature falling within the range, as follows. Namely, the ripening temperature is preferably 60 to 97° C., and more preferably, 70 to 90° C., and the ripening time is preferably 1 to 6 hours in terms of controlling a specific form of the domain.

Steps (g) to (h):

These steps can be conducted in accordance with ones generally known and employed.

In cases when internal additives are contained in the toner particles related to the present invention, for example, a dispersion of internal additive particles composed of an internal additive alone is prepared prior to the step (d), and in the step (d), the dispersion of internal additive particles is mixed with the respective dispersions and the internal additive particles are coagulated together with resin A particles, resin B particles and colorant particles, whereby the internal additive can be introduced into the interior of toner particles.

Fixing Device:

In the fixing step of the image forming method of the present invention, fixing is conducted by a fixing device in which at least one of a heating member and a pressing member comprises an endless belt entrained about plural rollers and the heating member and the pressing member are pressed against each other to form a fixing nip. Hereinafter, there will be described embodiments of a fixing device used in the image forming method of the present invention.

Figure 2:
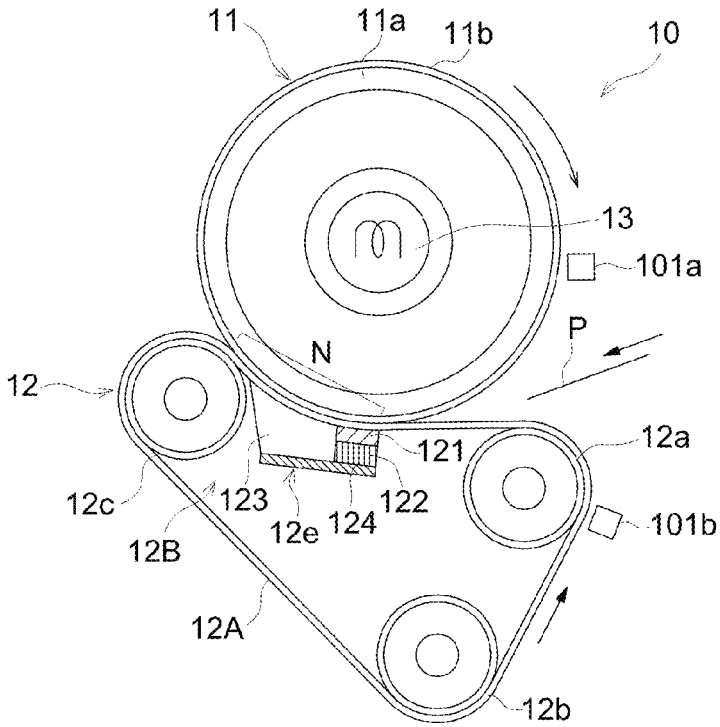
FIG. 2 illustrates a sectional view showing an example of the constitution of the fixing device used in the image forming method of the present invention.

FIG. 2 illustrates a sectional view showing an example of the constitution of the fixing device used in the image forming method.

A fixing device 10, which employs a belt nip system, is provided with a heating member 11 formed of a rotating roller (which is hereinafter also denoted as a heating roller 11), an endless belt 12A entrained about three rollers and a pressing member 12 formed of a pressure-applying member 12B, in which a fixing nip section N is formed by a pressing portion between the heating roller 11 and the pressure-applying member 12B in the pressing member 12.

A nip length of the fixing nip section N is preferably from 20 to 50 mm. When the nip length of the fixing nip section N falls within the foregoing range, image slippage is inhibited, while the formed image achieves enhanced glossiness. In the fixing device 10, the nip length of the fixing nip section N is, for example, 35 mm.

The heating roller 11 is built-in with a heating source 13 comprised of a halogen heater and the heating source 13 is constituted of an internally disposed, metallic cylindrical core 11*a* and a heat-resistant elastic material layer 11*b* formed on the circumference surface of the cylindrical core bar 11*a*.

The cylindrical core bar 11*a* constituting the heating roller 11 is constituted of a metal exhibiting a high heat conductivity, for example, iron, aluminum or an alloy. The heat-resistant elastic material layer 11*b* constituting the heating roller 11 is constituted of, for example, an elastic layer formed of a highly heat-resistant HTV silicone rubber and a releasing layer covering the elastic layer and formed of a fluororesin such as perfluoroalkyl vinyl ether (PFA) or polytetrafluoroethylene (PTFE).

The surface temperature ($T_1$) of the heating roller is preferably 130 to 170° C. (more preferably, 150 to 170° C.) in cases of a fixing linear speed of 340 mm/sec. A heating member temperature detector 101*a* is opposingly disposed on the surface of the heating roller 11 and based on a temperature measurement value of the temperature detector 101*a*, the heating source 13 is controlled by the control section of the image forming apparatus (not shown in the drawing), whereby the surface temperature ($T_1$) of the heating roller 11 is set. When the surface temperature ($T_1$) of the heating roller 11 is excessively low, it is a concern that the formed image cannot achieve high glossiness; on the other hand, when the surface temperature ($T_1$) of the heating roller 11 is excessively high, it is a concern that occurrence of image slippage is not sufficiently inhibited.

The pressing member 12 is constituted of the endless belt 12A entrained about belt-entraining rollers 12*a*, 12*b* and a pressure roller 12*c*, and the pressure-applying member 12B which presses the heating roller 11 onto the inner circumference of the endless belt 12A through the endless belt 12A.

The endless belt 12A constituting the pressing member 12A is entrained about the outer circumference of each of the belt-entraining roller 12*a* which is provided upstream from the fixing nip section N in the conveyance direction of a transfer material P, the belt-entraining roller 12*a* supporting the endless belt 12A and the pressure roller 12*c* which is provided downstream from the fixing nip section N, is in an endless form which is rotatably supported, and is rotatably driven with rotation of the belt-entraining rollers 12*a* and 12*b* and the pressure roller 12*c*.

The endless belt is constituted of a substrate formed of heat-resistant resin such as a polyimide, an elastic layer covering the surface of the substrate and formed of an elastic resin such as a silicone rubber, and a releasing layer covering the elastic layer and formed of a fluororesin such as PFA or PTFE.

The pressure-applying member 12B constituting the pressing member 12 is constituted of the pressure roller 12*c* and a pressure-applying member 12*e*. The pressure-applying member 12B is disposed while being in contact with the inner circumference of the endless belt 12A. The pressure-applying member 12B presses the heating roller 11 through the endless belt 12A from the inner circumference side of the endless belt 12A, whereby the fixing nip section N is formed between the heating roller 11 and the endless belt 12A.

The pressure roller 12*c* constituting the pressure-applying member 12B is provided in an are downstream from the fixing nip section N in the conveyance direction of the transfer material P. The pressure roller 12*c* exhibits a higher hardness than first, second and third pads 121, 122 and 123, and constituted of a cylindrical core bar formed of a metal such as aluminum, iron or an alloy. The pressure roller 12*c* has a function of supporting the endless belt 12A, while pressing the heating roller 11 from the inner circumference side of the endless belt 12A.

The pressing member 12*e* constituting the pressure-applying member 12B is constituted of a compression spring applying pressing power (not shown in the drawing), a holder housing these (not shown in the drawing) and a sliding sheet (not shown in the drawing) which is in contact with the inner circumference of the endless belt 12A covering the upper surfaces of the first pad 121 and the third pad 123, while supporting the first pad 121, the second pad 122, the third pad 123 and a supporting member 124.

The first pad 121 and the second pad 122 constituting the pressing member 12*e* form a member layer which is layered in a direction perpendicular to the conveyance direction of the transfer material P, and are provided in an are upstream from the fixing nip section N in the conveyance direction of the transfer material P. The first pad 121 which is a layer (upper layer) nearest to the fixing nip section N exhibits a lower hardness than the second pad 122 which is a layer (lower layer) farthest from the fixing nip section N.

The hardness of the whole member layers constituting the pressing member 12*e* is higher than that of the first pad 121 and not more than that of the second pad 122. For example, the first pad 121 is formed of a heat-resistant sponge and the second pad is formed of a heat-resistant urethane, whereby the hardness of the whole member layers becomes higher than that of the first pad 121 and lower than that of the second pad 122.

The third pad 123 constituting the pressing member 12*e* is disposed in a central region of the fixing nip section N along the conveyance direction of the transfer material P, that is, between a member layer constituted of the first pad 121 and the second pad 122 and the pressure roller 12*c*. The third pad 123 exhibits a lower hardness than the whole member layer constituted of the first pad 121 and the second pad 122. The third pad 123 is constituted of an elastic material, such as a heat resistant silicone rubber.

The supporting member 124 constituting the pressing member 12*e* is constituted of a metal plate such as stainless steel, supporting the first, second, third pads 121, 122, 123, and a resin plate supporting the metal plate, and is formed of a rigid material capable of maintaining a strength of not being broken even when subjected to an elastic force of a compression spring. The elastic force of the compression spring is provided as a constant compression power against the endless belt 12A through the supporting member 124, and the first, second, third pads 121, 122 and 123.

Herein, there will be described distribution of compression force within a fixing nip section in the conveyance direction of the transport material P. As described above, the pressure-applying member 12B is constituted of a member layer comprised of the first pad and the second pad 122 which are provided in the area upstream from the fixing nip section N along the conveyance direction of the transfer material P, the third pad 123 provided in the central region, and a pressure roller 12*c* provided in an area downstream, each of which exhibits a different hardness. The hardness (H1) of the whole member layer constituted of the first pad 121 and the second pad 122, the hardness (H2) of the third pad 123 and the hardness (H3) of the pressure roller 12*c* satisfy the following expression 1:

$$H3>H1>H2. \qquad \text{Expression 1}$$

The upstream area from the fixing nip section N in the conveyance direction of the transfer material P is subject to a pressure power P1 from a member layer constituted of the first pad 121 and the second pad 122. The downstream area from the fixing nip section N in the conveyance direction of the transfer material P is subject to a compression power P3 from the compression roller 12*c*. The central region of the fixing nip section N in the conveyance direction of the transfer material P is subject to a compression power P2 from the third pad 123. Accordingly, the distribution of compression power within the fixing nip section N is represented by the following expression 2:

$$P3>P1>P2 \qquad \text{Expression 2}$$

The surface temperature ($T_2$) of the pressing member 12, specifically, the endless belt 12A, is preferably from 90 to 110° C. in cases when the fixing linear rate is 340 mm/sec. A temperature detector 101*b* for the pressing member is opposedly disposed on the surface of the endless belt and the surface temperature ($T_2$) of the endless belt 12A is detected by the temperature detector 101*b*. The difference ($T_1-T_2$) between the surface temperature ($T_1$) of the heating roller 11 and the surface temperature ($T_2$) of the pressing member 12 is preferably from 40 to 70° C. In cases when the difference ($T_1-T_2$) falls within the foregoing range, an image of enhanced glossiness can be formed. When the difference ($T_1-T_2$) is excessively small, an image of enhanced glossiness may be formed but resistance to image slippage is lowered, producing a concern that uniformity of image glossiness becomes totally unstable.

In the fixing device 10, when the endless belt is rotated in the direction indicated by the arrow with being connected to a driving motor (not shown in the drawing), in accordance with this rotation, the endless belt 12A is moved in the same direction at the fixing nip section N of being pressed against the heating roller 11, and when the transfer material P, onto which a toner image is transferred, passes through the fixing nip section N, the toner image on the transfer material P is fixed by pressure from the pressure-applying member 12B and applied onto the fixing nip section N.

Thus, the fixing device which is suitably used for the image forming method of the present invention is described with respect to its embodiments, however, a fixing device used in the image forming method of the present invention is not limited to the foregoing embodiments and various variations can be employed. Hereinafter, there will be specifically described other embodiments.

Figure 3:
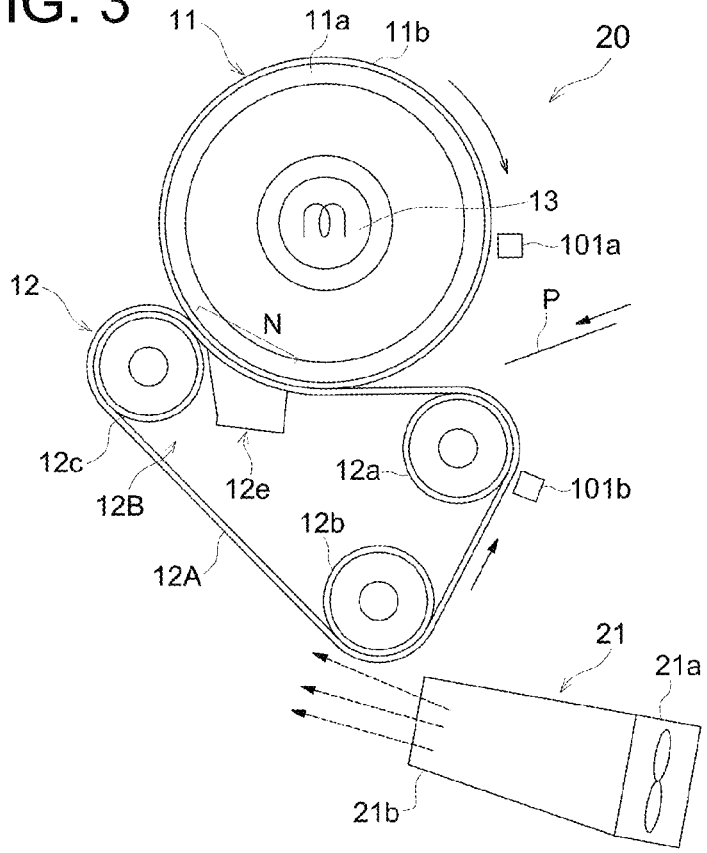
FIG. 3 illustrates a sectional view showing another example of the constitution of the fixing device used in the image forming method of the present invention.

FIG. 3 illustrates a sectional view showing another example of the constitution of the fixing device used in the image forming method. A fixing device 20, in which a temperature detector 101*b* for a pressing member is opposedly disposed on the surface of a pressing member 12, has the same constitution as the fixing device 10 shown in FIG. 2, except that there is disposed a cooler 21 to control the surface temperature of the pressing member 12, based on temperature values measured by the temperature detector 101*b*. The cooler 21 is constituted of plural fans (21*a*) and a duct for introducing Mr supplied by the fans (21*a*) in the prescribed direction. An excessive increase of the temperature of the pressing member 12 is inhibited by providing the cooler 21.

In the fixing device 20, the nip length of a fixing nip section (N) is 20 mm.

Figure 4:
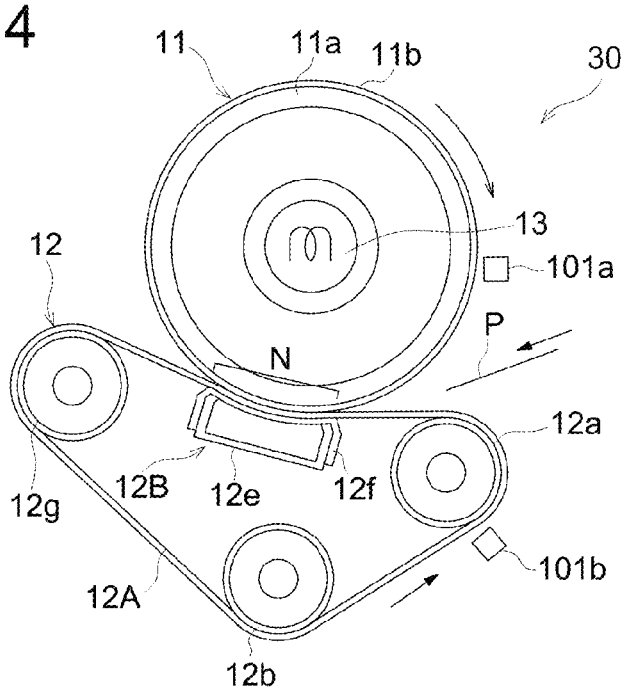
FIG. 4 illustrates a sectional view showing still another example of the constitution of a fixing device used in the image forming method of the present invention.

FIG. 4 also illustrates a sectional view showing another example of the constitution of the fixing device used in the image forming method. A fixing device 30 is constituted of a heating roller 11, an endless belt 12A entrained about belt-entraining rollers 12*a*, 12*b* and 12*g* and a compression member 12*e* constituting a pressure-applying member 12B, in which a fixing nip section N is formed by the compressed portion between a heating roller 11 and a pressure-applying member 12*e* constituting a pressure-applying member 12B. The upper surface of the compression member 12*e* constituting the pressure-applying member 12B is covered with a sliding sheet 12*f* with an embossed uneven surface. Covering the compression member 12*e* with the sliding sheet 12*f* decreases the contact area between the endless belt 12A and the compression member 12*e*, resulting in reduced sliding resistance.

Other constitutions of the fixing device 30 are basically the same as those of the fixing device shown in FIG. 2.

Further, in the fixing device 30, the nip length of the fixing nip section N is 40 mm.

Figure 5:
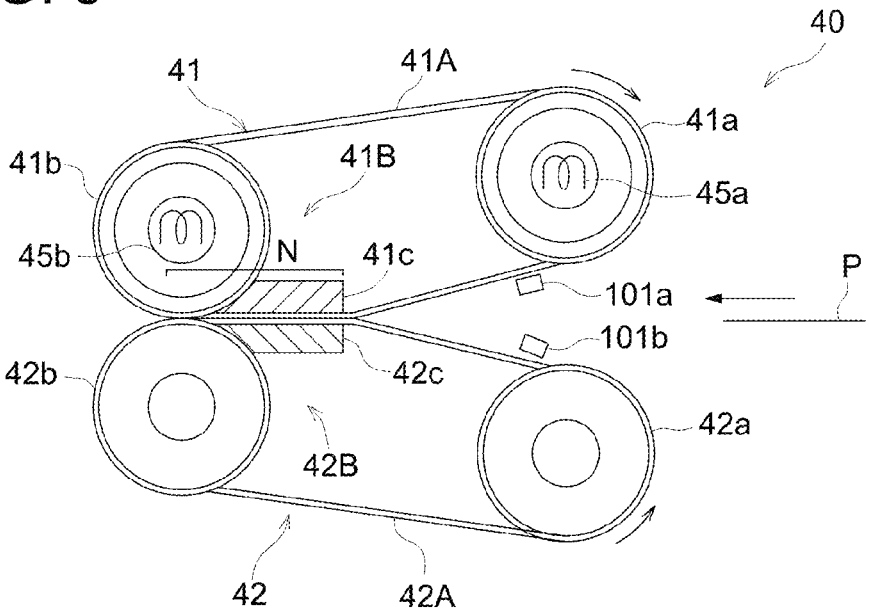
FIG. 5 illustrates a sectional view showing further another example of the constitution of a fixing device used in the image forming method of the present invention.

FIG. 5 also illustrates a sectional view showing another example of the constitution of the fixing device used in the image forming method. A fixing device 40 is provided with an endless belt 41A entrained about heating rollers 41*a* and 41*b* including heating sources 45*a* and 45*b*, a heating member 41 constituted of a pressure-applying member 41B which is disposed in contact with the inner circumference of the endless belt 41A, an endless belt 42A entrained about a belt-entraining roller 42*a* and a pressure roller 42*b*, and a pressing member 42 constituted of a pressure-applying member 42B which is disposed in contact with the inner circumference of the endless belt 42A.

The pressure-applying member 41B is constituted of the heating roller 41*b* and a pressing member 41*c* and has a function of pressing the pressing member 42 from the inner circumference of the endless belt 41A through the endless belt 41A. The pressure-applying member 42B is constituted of a pressing roller 42*b* and a pressing member 42*c* and has a function of pressing a heating member 41 through the endless belt 42A from the inner circumference of the endless belt 42A. These pressure-applying member 41B and pressure-applying member 42B apply pressure to each other to form a fixing nip section N.

The nip length of the fixing nip section N is 55 mm in the fixing device 40.

Figure 6:
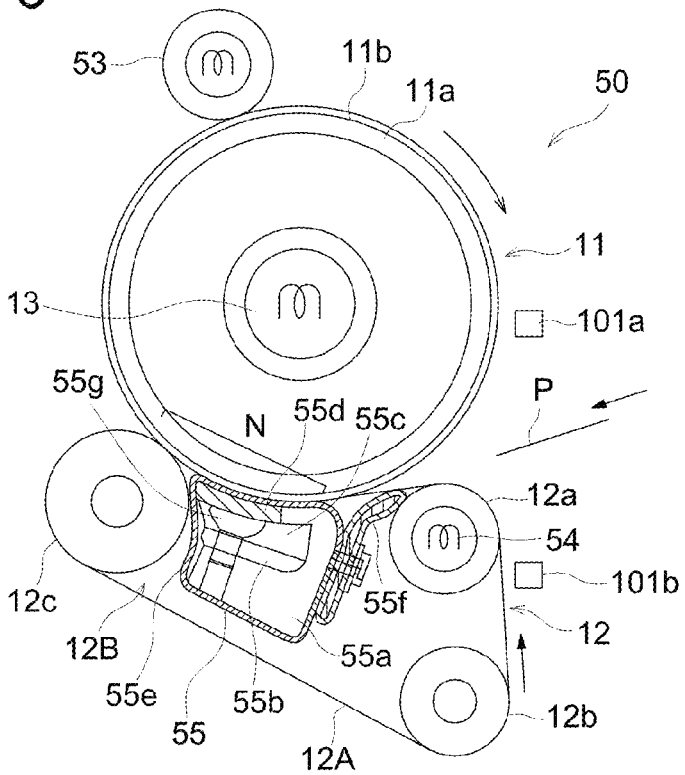
FIG. 6 illustrates a sectional view showing further another example of the constitution of a fixing device used in the image forming method of the present invention.

FIG. 6 also illustrates a sectional view showing another example of the constitution of the fixing device used in the image forming method. A fixing device 50 is provided, on the external surface of an external roller 11, with an external heating roller 53 which heats the external surface of the external roller 11 at a prescribed timing. In the drawing, the numeral 54 designates a heating source to heat an endless belt 12A enclosed within a belt-entraining roller.

A pressure-applying member 12B which pressurizes the heating roller 11 through the endless belt 12A is disposed on the inner circumference of the endless belt 12A, while being in contact therewith. The pressure-applying member 12B is constituted of a pressure roller 12*c* and a pressing member 55.

In the pressing member 55, an elastomer layer 55*d* layered on a supporting plate 55*c* formed of a metal such as stainless steel is disposed through a shim 55*b* composed of a synthetic resin such as polyphenylene sulfide (PPS) on the surface of a base plate 55*a* formed of a metal such as stainless steel. Further, the entire circumference surface of the pressing member 55 is covered with a pad sheet 55*e* as a sheet-like member. The numeral 55*g* designates a fixing thread to fix the supporting plate 55*c* onto the base plate 55*a*.

The inner circumference surface of the endless belt 12A is constituted so that, for example, an amine-modified silicone oil is coated by a lubricant-coating member 55*f* formed of a felt or the like, whereby friction between the endless belt 12A and the pad sheet 55*e* is reduced.

The pressing member 55 is disposed with being compressed toward the heating roller 11 under a compressive force of 50 kgf by a compressed coil spring (not shown in the drawing) disposed on the side of the base plate 55*a*. The pressing member 55 is provided with an elastic layer 55*d*, whereby the contact surface of the pad sheet 55*e* with the endless belt 12A is matches the outer circumference surface. Namely, when compressing the pressing member 55 toward the heating roller 11 by a prescribed load or more, the elastomer layer is deformed and the contact surface of the pad sheet 55*e* is deformed, while being compressed along the outer circumference surface of the heating roller 11. Accordingly, when the pressing member 55 is compressed against the heating roller 12 by the compressed coil spring (not shown in the drawing), the endless belt 12A is compressively brought into contact with the heating roller 11.

Other constitutions of the fixing device 50 are basically the same as those of the fixing device 10 shown hi FIG. 2.

Further, in the fixing device 50, the nip length of the fixing nip section N is 19 mm.

In the present invention, in cases when employing a fixing device of a belt-nip system, the use of a specific toner inhibits occurrence of image slippage, while maintaining enhanced glossiness of the formed image.

EXAMPLES

The present invention will be further described with reference to examples but the present invention is by no means limited to these. In Examples, unless otherwise noted, the expression, "part(s)" represents parts(s) by mass.

The volume-based median diameter of particles dispersed in a resin particle dispersion or a colorant particle dispersion can be measured in accordance with the following manner and conditions.

Measurement Method:

Into a 50 ml measuring cylinder were added a few drops of a particle dispersion for measurement and further thereto, 25 ml of pure water was added and dispersed over 3 minutes by using an ultrasonic washing machine (US-1, made by AS ONE co.) to prepare a measurement sample. Then, 3 ml of the measurement sample was placed into a cell of Microtrack UPA-150 (made by Nikkiso Corp.) and after confirming that the value of Sample/Loading was within the range of 0.1 to 100, measurement was conducted in accordance with the following measurement condition and solvent condition.

Measurement Condition:

Transparency: Yes

Refractive index: 1.59

Particle density: 1.05 g/cm$^3$

Spherical particles: Yes

Solvent Condition:

Refractive index: 1.33

Viscosity: High (temp.); $0.797\times10^{-3}$ Pa·s

Low (temp); $1.002\times10^{-3}$ Pa·s

The volume-based median diameter of toner particles was determined by using a measurement apparatus in which a Coulter Multisizer 3 (produced by Beckmann Coulter Co.) was connected to a computer system installed with software for data processing (Software V3.51). Specifically, 0.02 g of a toner was added to 20 ml of a surfactant solution (for example, a neutral detergent containing a surfactant component was diluted to ten times) and fitted, and then subjected to an ultrasonic dispersing treatment over 1 minute to prepare a toner dispersion. The thus prepared toner dispersion was introduced by a pipette into a beaker having ISOTON II (made by Beckman Coulter Co), placed in a sample stand until the display density of the measurement instrument reached 8%. Controlling the density so as to fall within this range rendered it feasible to obtain a reproducible measurement value. In the measurement instrument, the number of measurement particles was set to 25000 particles and the aperture diameter was set to 50 μm, and the measurement range of 1 to 30 μm was divided into 256 parts to calculate frequency values and the particle diameter at a fraction of 50% when integrated from larger particles was defined as the volume-based median diameter.

Example 1

Step (a-1): Preparation of Resin Particle Dispersion (1) First Polymerization:

Into a 5 liter reaction vessel fitted with a stirrer, a temperature sensor, a condenser and a nitrogen introducing device was placed a surfactant solution and the liquid temperature was raised to 80° C., while stirring at a rate of 230 rpm under a nitrogen gas stream. The surfactant solution contained 2 parts by mass of an anionic surfactant (sodium dodecylbenzenesulfonate, which is hereinafter also denoted as SDS) and 2900 parts by mass of deionized water. To the surfactant solution was added 9 parts by mass of a polymerization initiator (potassium persulfate, which is hereinafter also denoted as KPS). Further thereto, a monomer solution comprised of 550 parts by mass of styrene, 280 parts by mass of n-butyl acrylate, 45 parts by mass of methacrylic acid and 14.5 parts by mass of n-octyl mercaptan was dropwise added over 3 hours and after completing the addition, the reaction mixture was maintained at 78° C. over 1 hour to prepare a dispersion (al) of resin particles.

(2) Second Polymerization:

In 1100 parts by mass of deionized water was dissolved 12 parts by mass of an anionic surfactant [polyoxy(2)dodecyl ether sulfuric acid ester sodium salt] to prepare a surfactant solution. Into a monomer composition of 245 parts by mass of styrene, 95 parts by mass of n-butyl acrylate, 25 parts by mass of methacrylic acid and 4 parts by mass of n-octyl mercaptan in a flask fitted with a stirrer was added 195 parts by mass of behenyl behenate and heated at 85° C. to prepare a monomer solution (2).

Into a surfactant solution heated to 90° C. were added 260 parts by mass of the dispersion (a1) of resin particles and the monomer solution (2) and dispersed by mixing them in a mechanical dispersing machine having a circulation route (CLEARMIX, made by M-Technique Co., Ltd.) to prepare a dispersion.

To the thus prepared dispersion was added a polymerization initiator solution of 11 parts by mass of polymerization initiator (KPS) dissolved in 240 parts by mass of deionized water and stirred to 85° C. over 2 hours to prepare resin particle dispersion (a2).

(3) Third Polymerization:

A monomer solution (3) composed of 450 parts by mass of styrene, 125 parts by mass of n-butyl acrylate and 8 parts by mass of n-octyl mercaptan was prepared; a polymerization initiator solution of 10 parts by mass of a polymerization initiator (KPS) dissolved in 200 parts by mass of deionized water was added to the foregoing resin particle dispersion (a2) and further thereto, the monomer solution (3) was dropwise added under a temperature condition of 85° C. After completing addition, stirring continued with heating over 3 hours and then cooled to 28° C. to prepare a dispersion (A1) of resin particles (A1) having a multi-layered structure. It was proved that the thus prepared resin particles (A1) exhibited a volume-based median diameter of 160 nm, a glass transition point of 40° C., a softening point of 91° C., a storage modulus at 100° C. of $9.5\times10^3$ dyn/cm$^2$ and a mass average molecular weight (Mw) of 20,000. The glass transition point, softening point, storage modulus and mass average molecular weight (Mw) were determined in the manner described earlier.

Step (a-2): Preparation of Dispersion (C) of Shelling Resin

An aqueous surfactant solution of 2 parts by mass of an anionic surfactant (SDS) dissolved in 2900 parts by mass of deionized water was prepared in a reaction vessel fitted with a stirrer, a temperature sensor, a condenser and a nitrogen introducing device. The thus prepared aqueous surfactant solution was raised to a temperature of 80° C., while stirring at a rate of 230 rpm under a nitrogen stream.

After adding 9 parts by mass of a polymerization initiator (KPS) to the aqueous surfactant solution, a monomer solution composed of 516 parts by mass of styrene, 204 parts by mass of n-butyl acrylate, 100 parts by mass of methacrylic acid and 22 parts by mass of n-octyl mercaptan was added thereto over 3 hours.

After adding the foregoing monomer solution, the temperature of the reaction mixture was maintained at 78° C. for 1 hour to prepare a resin dispersion. To the resin dispersion after being cooled was added an aqueous solution of 0.7 parts by mass of a surfactant (Emal E-27C, made by KAO Co., Ltd.) dissolved in 4 parts by mass of deionized water to prepare a dispersion (C) of resin particles (C) to form a shell layer [hereinafter, also denoted as resin particles (C) used for shelling]. It was proved that the thus prepared resin particles (C) used for shelling exhibited a volume-based median diameter of 90 nm, a glass transition point of 50° C., a softening point of 111° C., and a mass average molecular weight (Mw) of 11,000.

Step (b): Preparation of Resin Particle Dispersion (B1)

Into a 5 liter reaction vessel fitted with a stirrer, a temperature sensor, a condenser and a nitrogen introducing device was placed a surfactant solution and the liquid temperature was raised to 80° C. with stirring at a rate of 230 rpm under a nitrogen gas stream. The surfactant solution contained 2.1 parts by mass of an anionic surfactant (SDS) and 1550 parts by mass of deionized water. To the surfactant solution was added 15 parts by mass of a polymerization initiator (KPS). Further thereto, a monomer solution comprised of 195 parts by mass of n-butyl acrylate, 60 parts by mass of itaconic acid, and 945 parts by mass of methyl methacrylate was dropwise added over 3 hours and after completing the addition, the reaction mixture was maintained at 78° C. for 1 hour to prepare a dispersion (B1) of resin particles. Resin particles (B 1) exhibited a volume-based median diameter of 90 nm, a glass transition point of 65° C., a softening point of 188° C., a storage modulus at 100° C. of $5.0\times10^7$ dyn/cm$^2$ and a mass average molecular weight (Mw) of 300,000.

Step (c): Preparation of Colorant Particle Dispersion (X)

Into a solution of 90 parts by mass of sodium dodecyl sulfate dissolved in 1600 parts by mass of deionized water was added 29 parts by mass of colorant, C.I. Pigment Blue 15 (copper phthalocyanine compound), while stirring. Then, the mixture was subjected to a dispersing treatment by using a mechanical stirrer, CLEARMIX (made by M-Technique Co., Ltd.) to prepare a colorant particle dispersion (X). It was proved that colorant particles exhibited a volume-based median diameter of 110 nm.

Step (d): Coagulation/Fusion of Resin Particles (A1) and (B1)

Into a reaction vessel fitted with a stirrer, a temperature sensor, and a condenser were added 390 parts by mass (solid content) of a resin particle dispersion (A1), 46 parts by mass (solid content) of a resin particle dispersion (B1), 1700 parts by mass of deionized water and 150 parts by mass of a colorant particle dispersion, while stirring. Further thereto, an aqueous 25% by mass sodium hydroxide solution was added and the pH was adjusted to a value of 10.0 to 10.3.

Subsequently, an aqueous solution of magnesium chloride hexahydrate (50% by mass) was added to the foregoing dispersion over 20 minutes, while stirring. After completing the addition, the temperature was raised to 75 to 80° C. over 60 minutes. Under this state, the size of coalesced particles within the reaction vessel was measured by MULTISIZER 3 (produced by Beckman Coulter Co.) When the size of coalesced particles reached 6.5 μm,100 parts by mass of aqueous 25% by mass sodium chloride was added to terminate growth of the particles to prepare a dispersion of particles. Subsequently, the dispersion was heated at 78° C. with stirring over 2 hours to obtain a dispersion (1) of aggregated particles (1) to be used for core particles of toner particles.

Step (e): Shelling

Subsequent to formation of the core particles, 26 parts by mass (solids) of a dispersion of the afore-described resin particles (C) used for shelling was further added at a temperature of 75 to 83° C. over 20 minutes. After completing the addition, stirring continued over 2 hours to allow the resin particles (c) to coagulate and fuse to form a shell layer on the core particle.

Steps (f): Ripening

After completing the foregoing shell formation, 200 parts by mass of an aqueous 25% by mass sodium chloride solution to terminate coagulation and fusion of shelling particles and then, the mixture was heated to 88° C. to perform ripening.

Steps (g) and (h): Washing and Drying

The particle dispersion formed in the step (f) was cooled at a rate of 4° C./min, then washed with 20° C. deionized water and dried under room temperature to prepare a toner (1) comprised of toner particles (1).

Step (b): Preparation of Resin Particle Dispersion (B3)

Into a 5 liter reaction vessel fitted with a stirrer, a temperature sensor, a condenser, and a nitrogen introducing device was placed a surfactant solution and the liquid temperature was raised to 80° C. with stirring at a rate of 230 rpm under a nitrogen gas stream. The surfactant solution composed of 3.6 parts by mass of an anionic surfactant (SDS) and 1550 parts by mass of deionized water. To the surfactant solution was added 15 parts by mass of a polymerization initiator (KPS). Further thereto, a monomer solution comprised of 195 parts by mass of n-butyl acrylate, 60 parts by mass of itaconic acid, and 945 parts by mass of methyl methacrylate was dropwise added over 3 hours and after completing the addition, the reaction mixture was maintained at 78° C. over 1 hour to prepare a dispersion (B3) of resin particles (B3). The thus prepared resin particles (B3) exhibited a volume-based median diameter, a glass transition point, a softening point, a storage modulus at 100° C. and a mass average molecular weight (Mw), as shown in Table 1.

Example 2

A toner (2) comprised of toner particles (2) was prepared in the same manner as in Example 1, except that the dispersion (B1) of resin particles (B1) used in the step (d) was replaced by a dispersion (B2) of resin particles (B2), and the amounts of the dispersion (A1), the dispersion (B2) and deionized water were changed to 298 parts by mass (solids), 138 parts by mass (solids) and 1695 parts by mass, respectively.

Step (b): Preparation of Resin Particle Dispersion (B2)

Into a 5 liter reaction vessel fitted with a stirrer, a temperature sensor, a condenser, and a nitrogen introducing device was placed a surfactant solution and the liquid temperature was raised to 80° C. with stirring at a rate of 230 rpm under a nitrogen gas stream. The surfactant solution composed of 1.5 parts by mass of an anionic surfactant, sodium dodecylsulfate (SDS) and 1550 parts by mass of deionized water. To the surfactant solution was added 15 parts by mass of a polymerization initiator, sodium persulfate (KPS). Further thereto, a monomer solution comprised of 195 parts by mass of n-butyl acrylate, 60 parts by mass of itaconic acid, and 945 parts by mass of methyl methacrylate was dropwise added over 3 hours and after completing the addition, the reaction mixture was maintained at 78° C. over 1 hour to prepare a dispersion (B2) of resin particles (B2). The thus prepared resin particles (B2) exhibited a volume-based median diameter, a glass transition point, a softening point, a storage modulus at 100° C. and a mass average molecular weight (Mw), as shown in Table 1.

Example 3

A toner (3) comprised of toner particles (3) was prepared in the same manner as in Example 1, except that the dispersion (B1) of resin particles (B1) used in the step (d) was replaced by a dispersion (B3) of resin particles (B3), and the amounts of the dispersion (A1), the dispersion (B3) and deionized water were changed to 413 parts by mass (solids), 23 parts by mass (solids) and 1695 parts by mass, respectively.

Step (b): Preparation of Dispersion (B3) of Resin Particles (B3)

Into a 5 liter reaction vessel fitted with a stirrer, a temperature sensor, a condenser and a nitrogen introducing device was placed a surfactant solution and the liquid temperature was raised to 80° C. with stirring at a rate of 230 rpm under a nitrogen gas stream. The surfactant solution was composed of 3.6 parts by mass of an anionic surfactant (SDS) and 1550 parts by mass of deionized water. To the surfactant solution was added 15 parts by mass of a polymerization initiator (KPS). Further thereto, a monomer solution comprised of 195 parts by mass of n-butyl acrylate, 60 parts by mass of itaconic acid, and 945 parts by mass of methyl methacrylate was dropwise added over 3 hours and after completing the addition, the reaction mixture was maintained at 78° C. over 1 hour to prepare a dispersion (B3) of resin particles (B3). The prepared resin particles (B3) exhibited a volume-based median diameter, a glass transition point, a softening point, a storage modulus at 100° C. and a mass average molecular weight (Mw), as shown in Table 1.

Example 4

A toner (4) comprised of toner particles (4) was prepared in the same manner as in Example 1, except that the ripening time in step (e) was varied to 5.5 hours.

Example 5

A toner (5) comprised of toner particles (5) was prepared in the same manner as in Example 1, except that the ripening time in step (e) was varied to 1 hours.

Example 6

A toner (6) comprised of toner particles (6) was prepared in the same manner as in Example 1, except that the dispersion (B1) of resin particles (B1) was replaced by a dispersion (B4) of resin particles (B4), as described below.

Step (b): Preparation of Dispersion (B4) of Resin Particles (B4)

Into a 5 liter reaction vessel fitted with a stirrer, a temperature sensor, a condenser and a nitrogen introducing device was placed a surfactant solution and the liquid temperature was raised to 80° C. with stirring at a rate of 230 rpm under a nitrogen gas stream. The surfactant solution composed of 3.6 parts by mass of an anionic surfactant (SDS) and 1550 parts by mass of deionized water. To the surfactant solution was added 15 parts by mass of a polymerization initiator (KPS). Further thereto, a monomer solution comprised of 168 parts by mass of n-butyl acrylate, 60 parts by mass of itaconic acid, and 972 parts by mass of methyl methacrylate was dropwise added over 3 hours and after completing the addition, the reaction mixture was maintained at 78° C. over 1 hour to prepare a dispersion (B4) of resin particles (B3). The prepared resin particles (B4) exhibited a volume-based median diameter, a glass transition point, a softening point, a storage modulus at 100° C. and a mass average molecular weight (Mw), as shown in Table 1.

Example 7

A toner (7) comprised of toner particles (7) was prepared in the same manner as in Example 1, except that the dispersion (A1) of resin particles (A1) was replaced by a dispersion (A2) of resin particles (A2). The dispersion (A2) of resin particles (A2) was prepared in the same manner as the dispersion (A1) of resin particles (A1) which was prepared in the step (a-1), except that, in the second polymerization stage, the amount of n-octyl mercaptan was change from 4 parts by mass to 3.87 parts.

Comparative Example 1

Comparative toner (8) comprised of comparative toner particles (8) was prepared in the same manner as in Example 1, except that the ripening time in the step (e) was varied to 8 hours.

Comparative Example 2

Comparative toner (9) comprised of comparative toner particles (9) was prepared in the same manner as in Example 1, except that the ripening time in the step (e) was varied to 0.5 hour.

Comparative Example 3

Into a 5 liter reaction vessel fitted with a stirrer, a temperature sensor, a condenser, and a nitrogen introducing device was placed a surfactant solution of 2.7 parts by mass of an anionic surfactant (SDS) dissolved in 2800 parts by mass of deionized water and the liquid temperature was raised to 80° C. with stirring at a rate of 230 rpm under a nitrogen gas stream. Further, the following composition was mixed and dissolved with being heated at 78° C. to prepare a monomer solution.

| | |
|---|---|
| Styrene | 30 parts by mass |
| Methyl methacrylate | 30 parts by mass |
| n-butyl acrylate | 33 parts by mass |
| Maleic acid | 40 parts by mass |

The foregoing monomer solution and the heated surfactant solution were mixed in a mechanical dispersing machine provided with a circulation pass to prepare emulsified particles having a uniform particle size. Further thereto was added an aqueous solution of 11.0 parts by mass of a polymerization initiator (KPS) dissolved in 400 parts by mass of deionized water and stirred for 2 hours with being heated at 78° C. to obtain a resin particle dispersion B5.

Comparative toner (10) comprised of comparative toner particles (10) was prepared in the same manner as in Example 1, except that the dispersion (A1) of resin particles (A1) and the dispersion (B1) of resin particles (B1) used in the step (d) were replaced by the resin particle dispersion (B5), and the ripening time in the step (e) was changed to 0.5 hour.

TABLE 1

| | Matrix Resin | | | | | | |
|---|---|---|---|---|---|---|---|
| Toner No. | Dispersion No. | Volume-based Median Diameter of Resin Particles A (nm) | Glass Transition Point (° C.) | Softening Point (° C.) | Mw | Storage Modulus at 100° C. (dyn/cm$^2$) | Domain Resin Dispersion No. |
| 1 | A1 | 160 | 40 | 91 | 20000 | $9.5 \times 10^3$ | B1 |
| 2 | A1 | 160 | 40 | 91 | 20000 | $9.5 \times 10^3$ | B2 |
| 3 | A1 | 160 | 40 | 91 | 20000 | $9.5 \times 10^3$ | B3 |
| 4 | A1 | 160 | 40 | 91 | 20000 | $9.5 \times 10^3$ | B1 |
| 5 | A1 | 160 | 40 | 91 | 20000 | $9.5 \times 10^3$ | B1 |
| 6 | A1 | 160 | 40 | 91 | 20000 | $9.5 \times 10^3$ | B4 |

TABLE 1-continued

| | | | | | | | |
|---|---|---|---|---|---|---|---|
| 7 | A2 | 155 | 45 | 98 | 27000 | $1.0 \times 10^5$ | B1 |
| 8 | A1 | 160 | 40 | 91 | 20000 | $9.5 \times 10^3$ | B1 |
| 9 | A1 | 160 | 40 | 91 | 20000 | $9.5 \times 10^3$ | B1 |
| 10 | A1 | 160 | 40 | 91 | 20000 | $9.5 \times 10^3$ | B5 |

| | Domain Resin | | | | | | |
|---|---|---|---|---|---|---|---|
| Toner No. | Volume-based Median Diameter of Resin Particles B (nm) | Glass Transition Point (° C.) | Softening Point (° C.) | Mw | Storage Modulus at 100° C. (dyn/cm$^2$) | Content, Based on Total Binder Resin (% by mass) | Ripening Time (hr) |
| 1 | 90 | 65 | 188 | 300000 | $5.0 \times 10^7$ | 10 | 2 |
| 2 | 140 | 65 | 190 | 300000 | $5.1 \times 10^7$ | 30 | 2 |
| 3 | 44 | 65 | 178 | 300000 | $4.9 \times 10^7$ | 5 | 2 |
| 4 | 90 | 65 | 188 | 300000 | $5.0 \times 10^7$ | 10 | 6 |
| 5 | 90 | 65 | 188 | 300000 | $5.0 \times 10^7$ | 10 | 1 |
| 6 | 90 | 70 | 195 | 300000 | $1.0 \times 10^8$ | 10 | 2 |
| 7 | 90 | 65 | 188 | 300000 | $5.0 \times 10^7$ | 10 | 2 |
| 8 | 90 | 65 | 188 | 300000 | $5.0 \times 10^7$ | 10 | 8 |
| 9 | 90 | 65 | 188 | 300000 | $5.0 \times 10^7$ | 10 | 1 |
| 10 | 100 | 60 | 120 | 150000 | $8.5 \times 10^7$ | 10 | 3 |

Evaluation

The thus obtained toners (1) to (7) were each mixed, in a V-shaped mixer, with ferrite carrier particles exhibiting a volume-based median diameter of 60 μm so that the toner content was 6% by mass, whereby developers 1 to 7 were prepared. The thus prepared developers 1 to 7 were each evaluated as below.

Further, using an atomic force microscope (AFM) SPI 3800N (produced Seiko Instrument Co.), toner particles (1) to (7) were each observed at room temperature with respect to a section of a particle, while being scanned in a micro-viscoelastic mode, and it was proved that each of binder resins had a domain/matrix structure. Further, there are shown, in Table 2, the ratio of domains exhibiting a major axis (L) falling within the range of 60 to 500 nm, the proportion of domains exhibiting a minor axis (W) falling within the range of 45 to 100 nm, the arithmetic average value of ratio (L/W) and the arithmetic average value of area S in an AMF elastic image of a 2 μm square area and obtained by using the atomic force microscope (AFM). The major axis (L), the minor axis (W), the arithmetic mean value of ratio L/W and the arithmetic mean value of area S were each measured and calculated in the manner described earlier.

(1) Evaluation of Image Slippage:

Using, as a A4 size transfer material, A4-sized coated paper, POD Gloss Coat (84.9 g/m$^2$, made by Oji Seishi Co., Ltd.), a solid image was formed which was set at a toner quantity of 1.2 g/cm$^2$ in accordance with the combination of a fixing device and a toner, as shown in Table 3. There was used an image forming apparatus in which a commercially available hybrid machine, bizhub PRO C6501 (made by Konica Minolta Business Technologies Inc.) was modified and fixing devices shown in FIGS. 2-6 were each provided. Formed images were visually observed and evaluated based on the criteria described below. Criteria A to C are acceptable in practice.

A: Transfer materials were conveyed without causing image slippage and no image defect such as uneven gloss was observed, B: Transfer materials were conveyed without causing image slippage but slightly uneven gloss was observed, C: Transfer materials were conveyed with causing slight image slippage and markedly uneven gloss was observed, D: Image slippage was caused and conveyance trouble occurred, and markedly uneven gloss was observed.

(2) Evaluation of Glossiness:

Using POD Gloss Coat (128 g/m$^2$, made by Oji Seishi Co., Ltd.), a solid image was formed which was set at a toner

TABLE 2

| | | | Domain | | | | Evaluation | | |
|---|---|---|---|---|---|---|---|---|---|
| | | | | | | | | Hot-Offset Property | |
| Example No. | Toner No. | Toner Tsp (° C.) | Ratio of Domain Having Major Axis (L) Falling within Range of 60 to 500 nm (% by number) | Ratio of Domain Having minor axis (W) Falling within Range of 45 to 140 nm (% by number) | Arithmetic Mean of Ratio (L/W) | Arithmetic Mean of Area (S) (μm$^2$) | Glossiness (%) | Non-Hot-Offset Region (° C.) | Low Temperature Fixability (° C.) |
| 1 | 1 | 103 | 100 | 100 | 2.9 | 0.0339 | 73 | 85 | 150 |
| 2 | 2 | 104 | 100 | 95 | 2.9 | 0.0447 | 61 | 75 | 155 |
| 3 | 3 | 102 | 95 | 92 | 3.0 | 0.0084 | 76 | 71 | 145 |
| 4 | 4 | 104 | 93 | 100 | 5.0 | 0.0585 | 60 | 90 | 160 |
| 5 | 5 | 101 | 87 | 100 | 1.5 | 0.0176 | 76 | 75 | 155 |
| 6 | 6 | 105 | 82 | 100 | 3.0 | 0.051 | 67 | 85 | 145 |
| 7 | 7 | 105 | 93 | 100 | 3.0 | 0.0351 | 61 | 85 | 165 |
| Comp. 1 | 8 | 104 | 78 | 100 | 1.3 | 0.152 | 72 | 50 | 150 |
| Comp. 2 | 9 | 100 | 100 | 77 | 5.2 | 0.0608 | 56 | 65 | 165 |
| Comp. 3 | 10 | 93 | not measurable | not measurable | — | — | 67 | 60 | 160 |

quantity of 1.2 g/cm$^2$ in accordance with the combination of a fixing device and a toner, as shown in Table 3. There was used an image forming apparatus in which a commercially available hybrid machine, bizhub PRO C6501 (made by Konica Minolta Business Technologies Inc.) was modified and fixing devices shown in FIGS. 2-6 were each provided. The glossiness of the formed image was measured and evaluated based on the criteria described below:

A: Glossiness is not less than 70%, and being excellent,

B: Glossiness is not less than 60% and less than 70%, and being superior,

C: Glossiness is less than 60%, and being poor.

A glossiness of not less than 60% was acceptable in practice. Glossiness was measured at a measurement angle of 75° using glossimeter GMX-203 (produced by Murakami Shikisai-Kogaku Kenkyusho), based on the surface of a glass with a refractive index of 1.567.

Evaluation results are shown in Table 3. In Table 3 are also shown linear velocity, nip length, nip-transit time, fixing pressure, surface temperature of heating member and that of pressing member and their difference. The nip-transit time is defined as d/v, where d is the length (mm) of a fixing nip section formed between a heating member and a pressing member in the moving direction, and v is the linear velocity (mm/sec). The surface temperature of the heating member or the pressing member was measured by the method described earlier.

TABLE 3

| | | | Fixing Condition | | | | | | | Evaluation | |
|---|---|---|---|---|---|---|---|---|---|---|---|
| Experiment No. | Fixing Device | Toner No. | Nip Velocity (mm/sec) | Nip Length (mm) | Nip Nio Transit Time (msec) | Fixing Pressure (Pa) | Surface Temperature ($T_1$) of Heating Member (° C.) | Temperature ($T_2$) of Pressing Member (° C.) | Difference ($T_1 - T_2$) | Image Slippage | Glossiness |
| 1 | FIG. 2 | 1 | 340 | 35 | 102.9 | 0.5 | 150 | 100 | 50 | A | 82 |
| 2 | FIG. 3 | 1 | 310 | 20 | 64.5 | 0.4 | 150 | 95 | 55 | A | 68 |
| 3 | FIG. 4 | 1 | 340 | 40 | 117.6 | 0.6 | 150 | 110 | 40 | B | 65 |
| 4 | FIG. 5 | 1 | 380 | 55 | 144.7 | 0.1 | 150 | 115 | 35 | B | 61 |
| 5 | FIG. 6 | 1 | 331 | 19 | 57.4 | 0.1 | 150 | 88 | 62 | A | 60 |
| 6 | FIG. 2 | 1 | 410 | 35 | 125 | 0.5 | 130 | 110 | 20 | B | 88 |
| 7 | FIG. 2 | 1 | 280 | 35 | 85.4 | 0.5 | 170 | 90 | 80 | A | 71 |
| 8 | FIG. 2 | 1 | 410 | 35 | 79.5 | 0.5 | 180 | 125 | 55 | B | 61 |
| 9 | FIG. 2 | 1 | 280 | 35 | 134.6 | 0.5 | 120 | 80 | 40 | A | 60 |
| 10 | FIG. 2 | 2 | 340 | 35 | 102.9 | 0.5 | 150 | 100 | 50 | A | 68 |
| 11 | FIG. 2 | 3 | 340 | 35 | 102.9 | 0.5 | 150 | 100 | 50 | B | 77 |
| 12 | FIG. 2 | 4 | 340 | 35 | 102.9 | 0.5 | 150 | 100 | 50 | A | 65 |
| 13 | FIG. 2 | 5 | 340 | 35 | 102.9 | 0.5 | 150 | 100 | 50 | B | 76 |
| 14 | FIG. 2 | 6 | 340 | 35 | 102.9 | 0.5 | 150 | 100 | 50 | A | 67 |
| 15 | FIG. 2 | 7 | 340 | 35 | 102.9 | 0.5 | 150 | 100 | 50 | A | 64 |
| 16 | FIG. 3 | 1 | 310 | 20 | 64.5 | 0.4 | 170 | 95 | 75 | B | 61 |
| 17 | FIG. 3 | 1 | 310 | 20 | 64.5 | 0.4 | 130 | 90 | 40 | A | 61 |
| 18 | FIG. 3 | 2 | 310 | 20 | 64.5 | 0.4 | 150 | 95 | 55 | A | 64 |
| 19 | FIG. 3 | 3 | 310 | 20 | 64.5 | 0.4 | 150 | 95 | 55 | B | 72 |
| 20 | FIG. 3 | 4 | 310 | 20 | 64.5 | 0.4 | 150 | 95 | 55 | A | 62 |
| 21 | FIG. 3 | 5 | 310 | 20 | 64.5 | 0.4 | 150 | 95 | 55 | B | 73 |
| Comp. 1 | FIG. 3 | 8 | 310 | 20 | 64.5 | 0.4 | 150 | 95 | 55 | D | 57 |
| Comp. 2 | FIG. 3 | 9 | 310 | 20 | 64.5 | 0.4 | 150 | 95 | 55 | D | 55 |
| Comp. 3 | FIG. 3 | 10 | 310 | 20 | 64.5 | 0.4 | 150 | 95 | 55 | D | 58 |

What is claimed is:

1. An image forming method comprising the steps of:

(a) transferring a toner image formed on an image support onto a transfer material, and (b) fixing the toner image transferred onto the transfer material, wherein in step (b), fixing is performed by a fixing device in which at least one of a heating member and a pressing member comprises an endless belt entrained about plural rollers, and the heating member and the pressing member are pressed against each other to form a fixing nip, and wherein a toner forming the toner image comprises toner particles containing a binder resin and the binder resin has a domain/matrix structure constituted of a high-elastic resin forming a domain and a low-elastic resin forming a matrix in an elastic image obtained when observing the toner particles by an atomic force microscope with respect to a section of the individual toner particles, in which an arithmetic average value of a ratio (L/W) of a major axis (L) to minor axis (W) of individual domains is in a range of 1.5 to 5.0, and domains having the major axis (L) falling within a range of from 60 to 500 nm account for not less than 80% by number of total domains and domains having the minor axis (W) falling within a range of from 45 to 100 nm account for not less than 80% by number of total domains, and wherein the high-elastic resin forming a domain exhibits a storage modulus of $4.0\times10^5$ to $1.0\times10^8$ dyn/cm$^2$ at 100° C. and the low-elastic resin forming a matrix exhibits a storage modulus of $1.0\times10^2$ to $1.0\times10^8$ dyn/cm$^2$ at 100° C.

2. The method of claim 1, wherein the heating member comprises a rotary roller and the pressing member comprises an endless belt entrained about plural rollers, and a pressure-applying member which presses against the heating member through the endless belt is provided on an inner circumference surface of the endless belt.

3. The method of claim 1, wherein a nip length of the fixing nip is 20 to 50 mm, a surface temperature of the heating member is from 150 to 170° C., a surface temperature of the pressing member is from 90 to 110° C., and a difference between the surface temperature of the heating member and the surface temperature of the pressing member being from 40 to 70° C.

4. The method of claim 1, wherein the endless belt is constituted of a substrate formed of a heat-resistant resin, an elastic layer covering the surface of the substrate and formed of an elastic resin, and a releasing layer covering the elastic layer and formed of a fluororesin.

5. The method of claim 1, wherein the fixing device is provided with a fan and a cooler constituted of a fan and a duct for introducing air supplied by the fan in the prescribed direction.

6. The method of claim 1, wherein the toner exhibits a softening point of 90 to 110° C.

7. The method of claim 1, wherein the toner exhibits a softening point of 95 to 105° C.

8. The method of claim 1, wherein, in an elastic image obtained when observing the toner particles by an atomic force microscope with respect to a section of the individual toner particles, an arithmetic average value of areas of individual domains is in a range of 0.01 to 0.05 $\mu m^2$.

* * * * *